US008221074B2

(12) United States Patent
Nelson

(10) Patent No.: US 8,221,074 B2
(45) Date of Patent: Jul. 17, 2012

(54) FAN RING SHROUD ASSEMBLY

(75) Inventor: Christopher A. Nelson, Sanger, TX (US)

(73) Assignee: PACCAR Inc, Bellevue, WA (US)

( * ) Notice: Subject to any disclaimer, the term of this patent is extended or adjusted under 35 U.S.C. 154(b) by 1182 days.

(21) Appl. No.: 11/963,408

(22) Filed: Dec. 21, 2007

(65) Prior Publication Data

US 2009/0162195 A1 Jun. 25, 2009

(51) Int. Cl.
*F04D 29/52* (2006.01)

(52) U.S. Cl. ..... 415/213.1; 415/214.1; 415/220

(58) Field of Classification Search ..... 415/220, 415/213.1, 214.1
See application file for complete search history.

(56) References Cited

U.S. PATENT DOCUMENTS

| | | | |
|---|---|---|---|
| 3,827,825 | A | 8/1974 | Shipes |
| 3,858,644 | A | 1/1975 | Beck |
| 3,937,192 | A | 2/1976 | Longhouse |
| 3,978,938 | A | 9/1976 | Joscher |
| 4,018,297 | A | 4/1977 | Haupt |
| 4,131,156 | A | 12/1978 | Crumrine, Jr. |
| 4,213,426 | A | 7/1980 | Longhouse |
| 4,398,508 | A | 8/1983 | Moon |
| 4,514,140 | A | 4/1985 | Knopf |
| 4,522,160 | A | 6/1985 | Speers |
| 4,662,822 | A | 5/1987 | Foeldesi |
| 4,706,615 | A | 11/1987 | Scadding |
| 4,741,669 | A | 5/1988 | Shimokawabe |
| 4,774,911 | A | 10/1988 | Yamaguchi |
| 4,836,148 | A | 6/1989 | Savage |
| 4,940,100 | A | 7/1990 | Ueda |
| 5,143,516 | A | 9/1992 | Christensen |
| 5,410,992 | A | 5/1995 | Hunt |
| 5,526,872 | A | 6/1996 | Gielda |
| 5,566,954 | A | 10/1996 | Hahn |
| 5,626,185 | A | 5/1997 | Gielda |
| 5,724,925 | A | 3/1998 | Ito |
| 5,775,450 | A | 7/1998 | Porter |
| 5,875,836 | A | 3/1999 | Nakamura |
| 6,189,492 | B1 | 2/2001 | Brown |
| 6,302,066 | B1 | 10/2001 | Steinmann |
| 6,622,807 | B2 | 9/2003 | Preiss |
| 7,004,732 | B2 | 2/2006 | Cho |
| 2006/0272800 | A1 | 12/2006 | Wong |

FOREIGN PATENT DOCUMENTS

| | | | |
|---|---|---|---|
| JP | 56099819 | A2 | 8/1981 |
| JP | 05131849 | A2 | 5/1993 |

*Primary Examiner* — Ninh H Nguyen
(74) *Attorney, Agent, or Firm* — Christensen O'Connor Johnson Kindness PLLC

(57) ABSTRACT

A shroud assembly for an engine cooling fan positioned between an engine and a radiator includes a ring shroud, a radiator shroud, and a flexible boot. The ring shroud is mounted adjacent to the fan and includes a locking feature. The radiator shroud, which is mounted to the rear of the radiator, has a first end with a first aperture for receiving air flowing rearwardly through the radiator, and a second end with a second aperture for discharging air received by the first aperture. A first end of the flexible boot engages the locking feature of the ring shroud to secure the flexible boot to the ring shroud. A second end of the flexible boot contacts the radiator shroud so that the boot provides fluid communication between the ring shroud and the radiator shroud.

19 Claims, 4 Drawing Sheets

FAN RING SHROUD ASSEMBLY

TECHNICAL FIELD

The present disclosure relates generally to engine cooling systems for vehicles such as trucks and, more particularly, to components for managing airflow through the radiator of an engine cooling system.

BACKGROUND OF THE INVENTION

In typical vehicle engine cooling systems, such as the one shown in FIG. 1, a liquid coolant is circulated through the engine 10 to transport heat away from the engine. For example, relatively low temperature coolant is introduced to channels in the engine. As the coolant circulates through the channels, heat from the engine is transferred to the coolant. The heated coolant then exits the engine, and the relatively hot coolant circulates through a series of passageways internal to a radiator 12 located at the forward end of the vehicle. Airflow through the series of passageways convectively transports heat away, thereby cooling the circulating coolant. The series of passageways is generally provided with fins to improve heat transfer performance. As a result, relatively low temperature coolant exits the radiator and is returned to the engine.

An engine-driven fan 14 is typically provided at the rear side (engine side) of the radiator 52 to enhance the airflow through the radiator 12, significantly increasing the heat transfer from the circulating coolant. The fan 14 is particularly important for maintaining airflow through the radiator when the vehicle is not moving. The fan 14 is oriented to draw air rearwardly through the radiator 12 and past the fan 14 into the engine compartment.

In order to optimize the flow of air drawn through the radiator 12 by the fan 14, a shroud assembly 16 is often provided. As shown in FIG. 1, a known shroud assembly 16 includes a radiator shroud 18 attached the rear side of the radiator 12 to receive air passing through the radiator 12 and to redirect the air toward the fan 14. A ring shroud 20 is attached to the engine 10 and surrounds the fan 14 so that the fan 14 is at least partially disposed within the ring shroud 20, with the tips of the fan blade positioned in close proximity to the ring shroud 20. The ring shroud 20 is secured to the engine 10 with one or more supports 21. The shroud assembly 16 further includes a flexible cylindrical boot 22 secured at one end to the outlet of the radiator shroud 18 and at the other end to the inlet of the ring shroud 20. The boot 22, which may be extruded or rolled from a flat material, is secured to the radiator shroud 18 and the fan ring shroud 20 with band clamps 24.

Presently known shroud assemblies include several inherent disadvantages. First, when the vehicle is assembled, the flexible boot is secured to the ring shroud with a first clamp and held in a compressed state with restraints while the cooling module, i.e., the radiator and radiator shroud are installed. Once the cooling module is installed, the restraints are removed, and the flexible boot expands to seat against the radiator shroud. The boot is then secured to the radiator shroud with a second clamp. This process adds additional time and cost to the assembly process. In addition, the clamps used to secure the boot to the ring shroud and the radiator shroud are prone to failure, which can result in damage to the boot and the fan.

Other presently known shroud assemblies include a shroud ring and boot formed by rolling extruded parts into a ring configuration. In these shroud assemblies, a flexible boot extrusion is threaded into an aluminum ring extrusion, and then the boot extrusion and the ring extrusion are rolled into a ring shape. This process typically results in an undesirable number of distorted or failed parts. In addition, the process adds to the required manufacturing time, thereby further increasing the cost of the parts.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A shroud assembly for an engine fan is disclosed. The fan is positioned between an engine and a radiator. The shroud assembly includes a ring shroud, which has a locking feature, mounted near the fan. A radiator shroud is mounted to the rear of the radiator, i.e., on the engine side. One end of the radiator shroud includes an opening to receive air that flows through the radiator. Air received from the radiator is discharged through an opening in the second end of the radiator shroud.

A flexible boot connects the radiator assembly to the shroud assembly. A first end of the boot lockingly engages the locking feature of the ring shroud to secure the boot to the ring shroud. The second end of the boot contacts the second end of the radiator shroud to form a seal therebetween. With the boot thusly connected to the ring shroud and the radiator shroud, the ring shroud is in fluid communication with the radiator shroud.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

For clarity in the following description, directional terms such as forward, rear, etc. have been used to describe one suitable embodiment of the shroud assembly as used with a typical vehicle wherein a radiator is mounted forward of an engine in an engine compartment, and a cooling fan is mounted to the forward side of the engine. However, it will be appreciated that the shroud assembly of the presently claimed subject matter may be used with differently configured combinations of engines and radiators and thus, the directional terms will change accordingly. Therefore, such terms should be viewed as merely descriptive and non-limiting.

Figure 2:
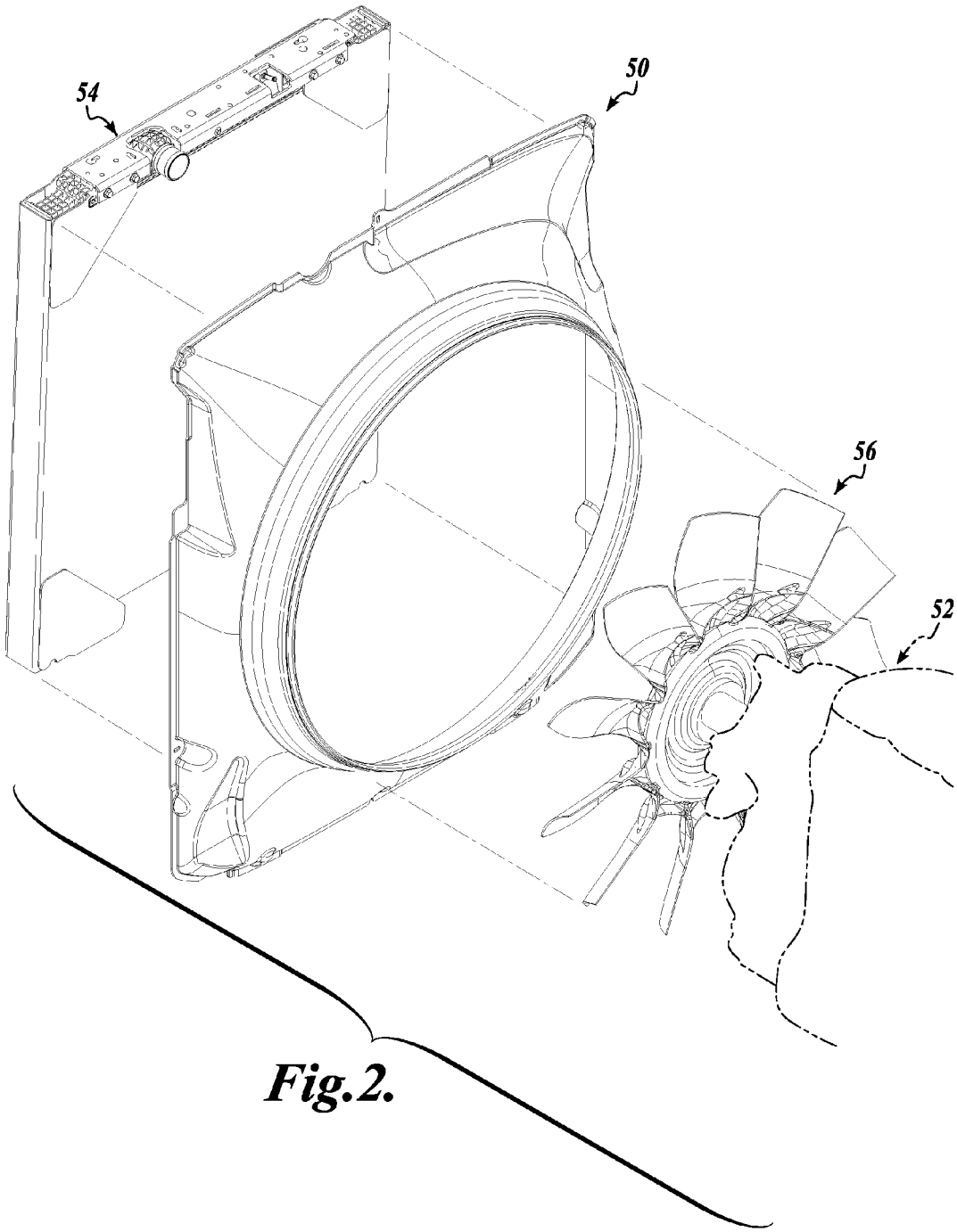
FIG. 2 is an exploded isometric view of an exemplary embodiment of a fan shroud assembly according to the present disclosure.

Referring now to FIG. 2, an exemplary embodiment of a shroud assembly 50 is shown. In the illustrated embodiment, the shroud assembly 50 is adapted for use in the engine compartment of a vehicle, such as a car or a heavy duty truck. A vehicle engine 52 is disposed within the engine compartment, and a radiator 54 is positioned in the engine compartment forward of the engine 52. The radiator 54 is in fluid communication with the engine 52 to allow the exchange of coolant between the engine 52 and the radiator 54. The coolant, which is used to manage the operating temperature of the engine 52, carries heat from the engine 52. Heat from the coolant is dissipated by the radiator surface as the coolant passes through the radiator 54. Air flow through the radiator 54 increases the amount of heat dissipated from the coolant by enabling forced convection from the surface of the radiator.

To provide air flow through the radiator 54, a fan 56 is provided, which is rotatably mounted to the forward end of the engine 52 so that the fan 56 is positioned between the engine 52 and the radiator 54. Rotation of the fan 56 draws air in a rearward direction through the radiator 54 toward the engine 52. This air flow causes forced convection across the surface of the radiator 54, thereby increasing the amount of heat dissipated from the coolant.

Figure 3:
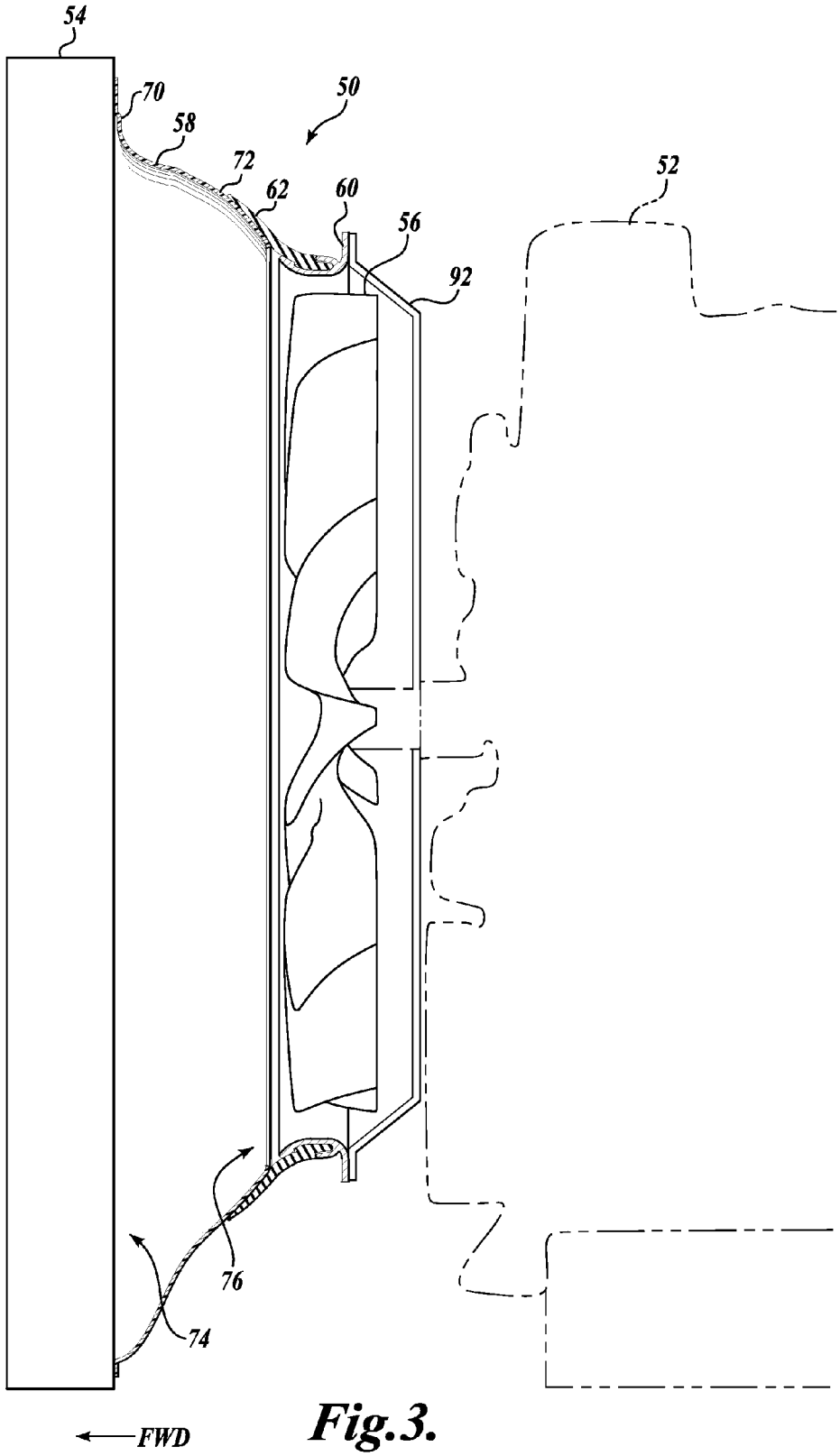
FIG. 3 is a side cutaway view of the fan shroud assembly shown in FIG. 2.

The shroud assembly 50 is positioned between the engine 52 and the radiator 54 in order to increase the airflow induced by the fan 56 through the radiator 54. As shown in FIG. 3, the shroud assembly 50 includes a radiator shroud 58, a ring shroud 60, and a flexible boot 62. The components of the exemplary shroud assembly 50 will be described in turn.

Figure 4:
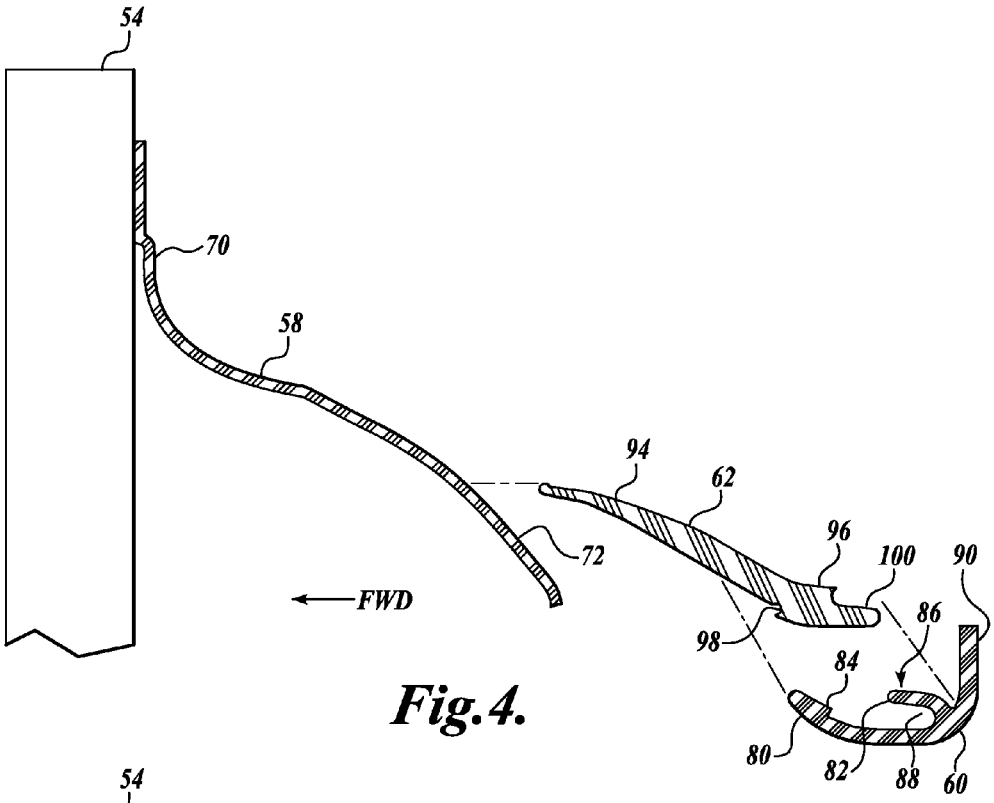
FIG. 4 is an exploded, partial side cutaway view of the fan shroud assembly shown in FIG. 2 with a boot in an undeflected position.
Figure 5:
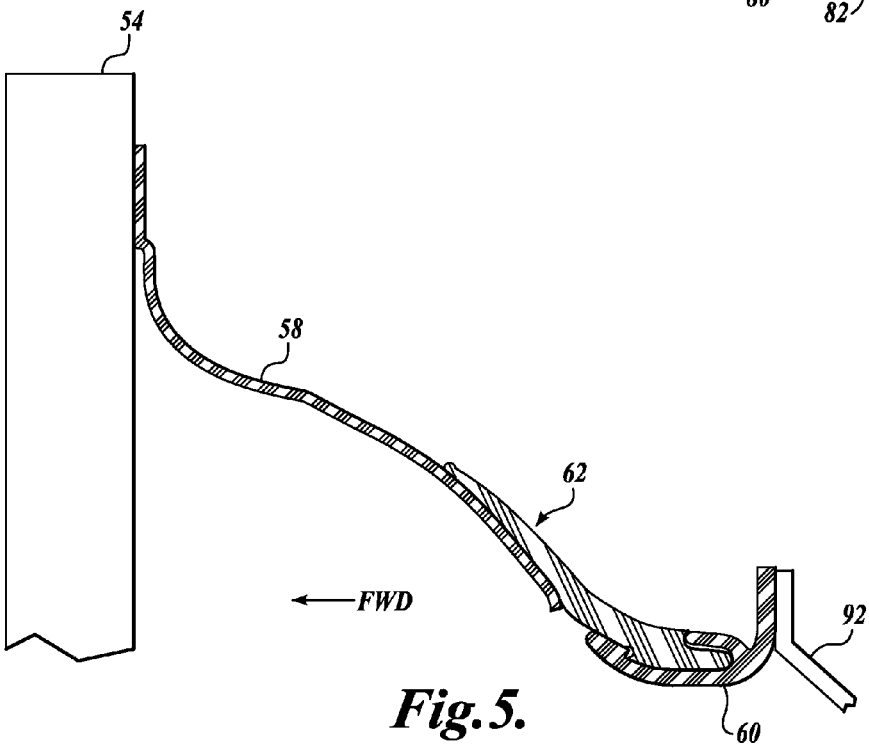
FIG. 5 is partial side cutaway view of the fan shroud assembly shown in FIG. 2 with the boot in an installed, deflected position.

Referring to FIGS. 3-5, the radiator shroud 58 includes a forward portion 70, which has a first aperture 74 for receiving air that passes rearwardly through the radiator 54, and a rear portion 72, which has a second aperture 76 for discharging the received air from the shroud 58. The forward portion 70 of the radiator shroud 58 is formed to substantially cover the rear side of the radiator 54 so that at least a portion of the air traveling rearwardly through the radiator 54 enters the first aperture 74 at the forward portion 70 of the radiator shroud 58. As shown in FIGS. 2 and 3, the rear portion 72 of the radiator shroud 58 defines the second aperture 76, which is substantially round, and through which airflow taken in at the forward portion 70 is discharged in a rearward direction. Referring specifically to FIG. 3, the rear portion 72 has a concave cross-section that provides a transition from the forward section 70 to the second aperture 76 at the rear portion 72 The radiator shroud 58 is preferably molded from a rigid polymer; however it should be appreciated that any suitable material, such as metal or composites, can by utilized. Further, any manufacturing processes suitable for the chosen material should be considered within the scope of the present disclosure.

The radiator shroud 58 is positioned at the rear side of the radiator 54 and is secured to the radiator 54 with mechanical fasteners or other known fastening means. It should be appreciated that the radiator shroud 58 may also be secured to the engine 52, the sidewalls of the engine compartment, or any other structure suitable to maintain the position of radiator shroud 58 relative to the radiator 54.

As best shown in FIGS. 3 and 4, the ring shroud 60 is made from an extrusion that is formed into a substantially circular ring. The ends of the extrusion are joined together so that the ring formed by the extrusion defines a closed curve. Referring specifically to the cross-sectional view of FIG. 4, the ring shroud 60 includes a generally horizontal first leg 80 extending in a forward direction and a protrusion 82 extending radially outward and forward from a rear portion of the first leg 80. In addition, a lip 84 is located at the forward end of the first leg 80 and extends radially around the ring. The first leg 80, the protrusion 82 and the lip 84 cooperate to define a generally "C" shaped channel 86 extending around the outer perimeter of the ring shroud 60. The channel defines a cavity 88 that opens to the forward side of the ring shroud 60. The ring shroud 60 further includes a second leg 90 that extends radially outward from the rear portion of the first leg 80.

As shown in FIG. 3, the ring shroud 60 is mounted to the engine 50 through one or more supports 92. Each support 92 has a first end, which is attached to the second leg 90 of the ring shroud 60, and a second end, which is attached to the engine. The supports 92 secure the ring shroud 60 in a fixed position relative to the engine 52 so that the engine fan 56 is at least partially disposed within the center portion of the ring shroud 60.

As best shown in FIGS. 3 and 4, the boot 62 is molded from a flexible material to form a ring. Referring to FIG. 4, the forward end 94 of the boot 62 has an elongated, slightly concave cross-section. The forward end 94 of the boot 62 defines an aperture larger than the aperture of the rear portion 72 of the radiator shroud 58. The rear end 96 of the boot 62 includes a joggle so that the rear end 96 is offset towards the center of the ring formed by the boot 62. The offset of the joggle defines a heel portion 98 at the forward side of the joggle and results in a toe portion 100 at the rear side of the joggle. The toe portion 100 is sized and configured to cooperate with the channel opening 88, as will be described in detail below.

In the illustrated embodiment, the boot 62 is molded from a flexible polymer as a monolithic piece. The stiffness of the boot 62 can be controlled by providing local variation in the thickness of the boot 62 in areas in which increased stiffness is desired. In alternate embodiments, stiffening inserts are molded into the boot 62 or attached to the boot after the boot is manufactured in order to provide additional local stiffness. In still another embodiment, the boot 62 is not molded, but is instead formed from a flexible polymeric extrusion, wherein the ends of the extrusion are joined by adhesives or other suitable means in order to form a ring.

As shown in FIG. 4, the boot 62 is removably attached to the ring shroud 60 by inserting the toe portion 100 of the boot 62 into the channel 86 of the ring shroud 60. In the disclosed embodiment, the diameter of the rear end 96 of the boot 62 is equal to or smaller than the diameter of the inside of the channel 86. As a result, the rear end of the boot 62 is stretched to fit over the forward end of the ring shroud 60, and the elasticity of the boot 62 helps to keep the rear end 96 of the boot 62 engaged with the channel 86.

With the toe portion 98 of the boot 62 inserted into the channel 86 of the ring shroud 60, the boot 62 is restrained from movement relative to the ring shroud 60 in all directions. The channel 86 engages the toe portion 100 to define a first locking feature that restrains the rear end 96 of the boot from moving in a rearward direction relative to the ring shroud 60. At the same time, the forward side of the heel portion 98 of the boot 62 engages the rear side of the lip 84 of the ring shroud 60 to define a second locking feature that restrains the rear end 96 of the boot 62 from moving in a forward direction relative to the ring shroud 60. In addition, the elasticity of the boot 62 resists stretching of the boot 62 that would result in any radial movement of the rear end 96 of the boot 62 relative to the ring shroud 60.

Figure 1:
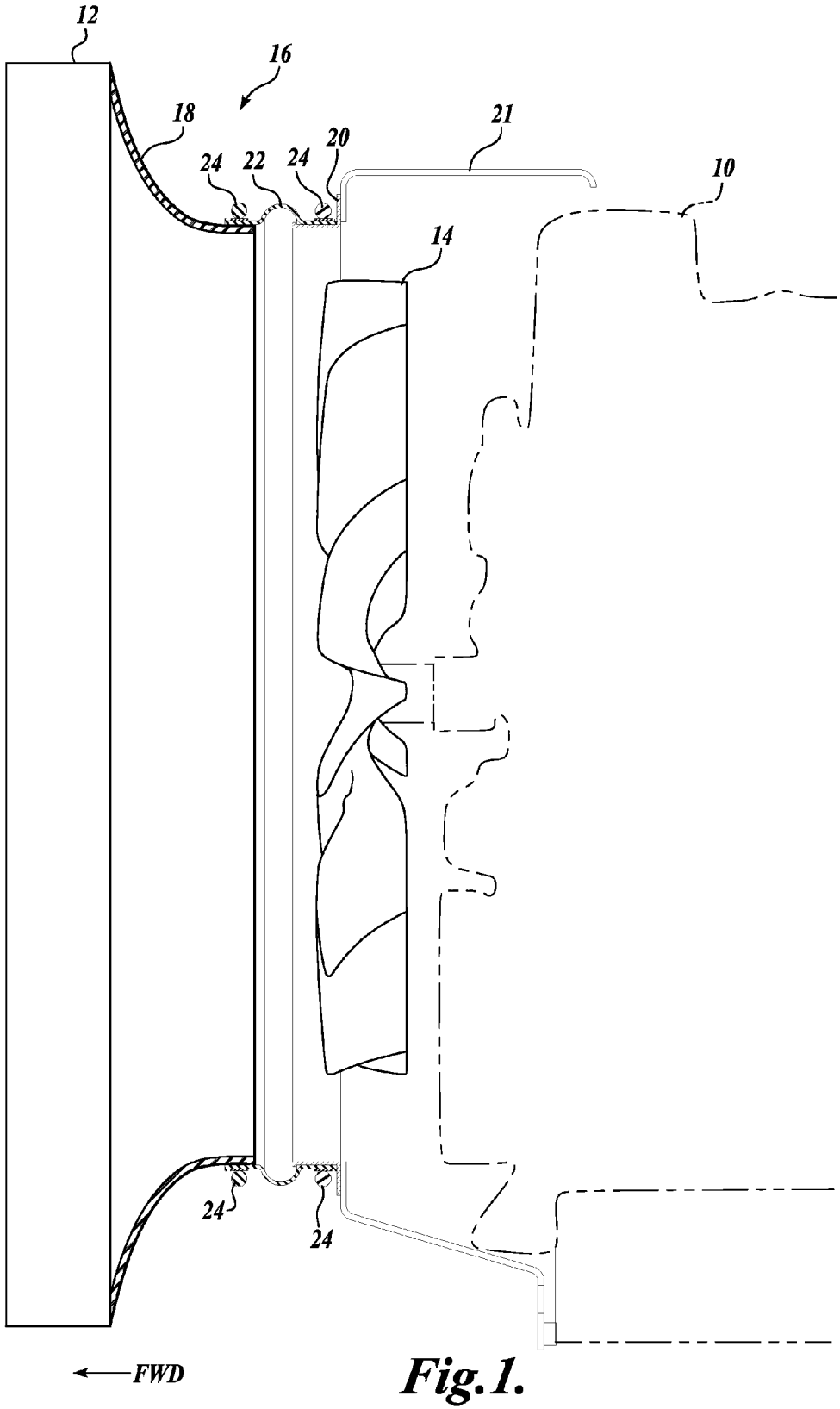
Fig.1. (PRIOR ART)
FIG. 1 is a side cutaway view of a currently known fan shroud assembly.

In one exemplary sequence for installing the shroud assembly 50, the flexible boot 62 and the radiator shroud 60 are first pre-assembled. The flexible boot 62 is removably attached to the ring shroud 60 by inserting the toe portion 100 of the boot 62 into the channel 86 of the ring shroud 60 to engage the first and second locking features. The first and second locking features, combined with the elasticity of the boot 62, allows the boot 62 to be removably attached to the ring shroud without the use of clamps or additional fasteners. As a result, part count, manufacturing cost, and assembly time are all reduced. In addition, the elimination of clamps used in known configurations shown in FIG. 1 eliminates the chance that a clamp will come loose during operation and damage the engine 52 or the fan 56.

With the flexible boot 62 secured to the ring shroud 60, the ring shroud 60 is attached to the forward side of the engine 52. The engine is then installed in the engine compartment, thereby positioning the ring shroud 60 and the flexible boot 62 within the engine compartment.

The radiator shroud 58 is attached to the radiator 54 prior to installing the radiator 54. After the engine is installed, the radiator 54 and the radiator shroud 58 are installed in the engine compartment as a unit. As shown in FIG. 5, when the radiator 54 and radiator shroud 58 are so installed, the rear portion 72 of the radiator shroud 58 contacts the forward end 94 of the boot 62 and forms a seal therebetween.

When installing the radiator 54 into the engine compartment, it may not be possible to lower the radiator 54 and radiator shroud 58 directly down into position in the engine compartment due to the interference between the radiator shroud 58 and the boot 62. Accordingly, it may be necessary to tilt the radiator 54 forward and then lower the radiator 54 into the engine compartment so that the radiator shroud 54 does not interfere with the boot 62. After the radiator 54 lowered into place, the radiator 54 is rotated in a rearward direction until it is in the installed position. As the radiator 54 is rotated toward the installed position, the radiator shroud 54 contacts the boot 62 to form a seal.

The flexible boot 62 deforms as needed to accommodate manufacturing tolerances. Further, because the boot 62 is preloaded against the radiator shroud 58, the boot 62 maintains contact, and thus a seal, with the radiator shroud 58, even when there is relative movement between the engine 52 and radiator 54. Because constant contact is maintained between the boot 62 and the radiator shroud 58, it is unnecessary to secure the boot 62 to the radiator shroud 58 with clamps or additional fasteners used in known configurations. As with the elimination of clamps at between the boot 62 and the ring shroud 60, this reduces part count, manufacturing cost, and assembly time. It also eliminates the possibility that a clamp that would otherwise be necessary will come loose and damage the engine 52 or the fan 56.

It will be appreciated by one of skill in the art that while exemplary embodiments are described, several alternate embodiments are possible and should be considered within the scope of the present disclosure. In one alternate embodiment, the boot 62 is reversed so that it is removably attached to the radiator shroud 50 and deforms to maintain contact with the ring shroud. In another alternate embodiment, the rear end 96 of the boot 62 has an end with one of a number of predetermined profiles that is retained within a cavity in the ring shroud with a corresponding profile by an interference fit. In yet another embodiment the ring shroud supports are integral to the engine or accessories mounted to the engine. Thus, while illustrative embodiments have been illustrated and described, it will be appreciated that various changes can be made therein without departing from the spirit and scope of the invention as claimed.

The embodiments of the invention in which an exclusive property or privilege is claimed are defined as follows:

1. A shroud assembly for an engine cooling fan, the fan being disposed between an engine and a radiator, the shroud assembly comprising:

(a) a ring shroud fixedly mounted adjacent to the fan and having a locking feature formed therein, the locking feature comprising:
  (i) a C-shaped channel having opening at a forward end; and
  (ii) a lip disposed forward of the opening of the C-shaped channel and extending in a radially outward direction;

(b) a radiator shroud mounted rearward of the radiator, the radiator shroud having a first end with a first aperture located to receive at least a portion of air flowing rearwardly through the radiator, and a second end with a second aperture for discharging air received by the first aperture; and (c) a flexible boot having a first end and a second end, the first end of the boot lockingly engaging the locking feature of the ring shroud to removably attach the flexible boot to the ring shroud, the second end of the boot being in contact with the second end of the radiator shroud so that the boot provides fluid communication between the ring shroud and the radiator shroud, the flexible boot comprising:
  (i) a toe portion extending in a rearward direction and being disposed within the channel, the channel restraining the toe portion in a radial direction; and
  (ii) a forward facing surface disposed forward of the toe portion and extending in a radially inward direction.

2. The shroud assembly of claim 1, wherein the ring shroud is mounted using one or more supports, each support having a first end coupled to the ring shroud and a second end coupled to the engine.

3. The shroud assembly of claim 1, wherein the flexible boot is a monolithic molded polymeric material.

4. The shroud assembly of claim 1, wherein the ring shroud is an extrusion modified to form a closed curve.

5. The shroud assembly of claim 4, wherein the ring shroud locking feature is a channel formed in the extrusion.

6. The shroud assembly of claim 5, wherein the first end of the flexible boot comprises a joggle, the joggle being capable of lockingly engaging the channel formed in the extrusion.

7. The shroud assembly of claim 1, wherein the second end of the flexible boot has a concave cross-section.

8. The shroud assembly of claim 1, wherein the second end of the radiator has a concave cross-section.

9. A fan shroud assembly for use in a vehicle having a radiator, an engine, and a cooling fan mounted to the engine, the fan shroud assembly comprising:

(a) a ring shroud adapted to be fixedly mounted relative to the engine and positioned adjacent to the fan, the ring shroud having a locking feature formed therein, the locking feature comprising:
  (i) a C-shaped channel having opening at a forward end; and
  (ii) a lip disposed forward of the opening of the C-shaped channel and extending in a radially outward direction;

(b) a radiator shroud mounted rearward of the radiator, the radiator shroud having a first end with a first aperture located to receive at least a portion of air flowing rearwardly through the radiator, and a second end with a second aperture for discharging air received by the first aperture; and (c) a flexible boot having a first end and a second end, the first end being lockingly engagable to the locking feature of the ring shroud to removably attach the flexible boot to the ring shroud, a preload maintaining sliding contact between the flexible boot and the radiator shroud, the boot providing fluid communication between the ring shroud and an area at a rear end of the radiator, the flexible boot comprising:

(i) a toe portion extending in a rearward direction and being disposed within the channel, the channel restraining the toe portion in a radial direction; and (ii) a forward facing surface disposed forward of the toe portion and extending in a radially inward direction.

10. The fan shroud assembly of claim 9, wherein the ring shroud is an extrusion modified to form a closed curve.

11. The fan shroud assembly of claim 10, wherein the ring shroud locking feature is a channel formed in the extrusion.

12. The fan shroud assembly of claim 11, wherein the first end of the flexible boot comprises a joggle, the joggle being capable of lockingly engaging the channel formed in the extrusion.

13. The shroud assembly of claim 9, wherein the second end of the flexible boot has a concave cross-section.

14. A vehicle having an engine compartment, the vehicle comprising:

(a) an engine mounted within the engine compartment;

(b) a radiator disposed within the engine compartment, the radiator being located forward of the engine and being adapted to manage engine temperature;

(c) a fan rotatably mounted to the engine, the fan having a plurality of blades extending radially from a fan hub;

(d) a ring shroud fixedly attached to the engine, the ring shroud being located adjacent to the plurality of fan blades;

(e) a radiator shroud mounted at a rear surface of the radiator, the radiator shroud having a first end with a first aperture located to receive at least a portion of air flowing rearwardly through the radiator, and a second end with a second aperture for discharging air received by the first aperture, the ring shroud having a locking feature formed therein, the locking feature comprising:

(i) a C-shaped channel having opening at a forward end; and (ii) a lip disposed forward of the opening of the C-shaped channel and extending in a radially outward direction; and (f) a flexible boot having a first end and a second end, the first end lockingly engaging the locking feature of the ring shroud to removably attach the flexible boot to the ring shroud, the second end being in contact with the second end of the radiator shroud so that the boot provides fluid communication between the ring shroud and the radiator shroud, the flexible boot comprising:

(i) a toe portion extending in a rearward direction and being disposed within the channel, the channel restraining the toe portion in a radial direction; and (ii) a forward facing surface disposed forward of the toe portion and extending in a radially inward direction.

15. The shroud assembly of claim 14, wherein the ring shroud is mounted using one or more supports, each support having a first end coupled to the ring shroud and a second end coupled to the engine.

16. The shroud assembly of claim 14, wherein the ring shroud is an extrusion modified to form a closed curve.

17. The shroud assembly of claim 16, wherein the ring shroud locking feature is a channel formed in the extrusion.

18. The shroud assembly of claim 17, wherein the first end of the flexible boot comprises a joggle, the joggle being capable of lockingly engaging the channel formed in the extrusion.

19. The shroud assembly of claim 14, wherein the second end of the flexible boot has a concave cross-section.

* * * * *